US010597842B1

(12) United States Patent
Beller

(10) Patent No.: US 10,597,842 B1
(45) Date of Patent: Mar. 24, 2020

(54) EXCAVATION SHORING

(71) Applicant: B&H Construction, LLC, Norman, OK (US)

(72) Inventor: Donnie Beller, Goldsby, OK (US)

(73) Assignee: B&H Construction, LLC, Norman, OK (US)

( * ) Notice: Subject to any disclaimer, the term of this patent is extended or adjusted under 35 U.S.C. 154(b) by 0 days.

(21) Appl. No.: 16/271,531

(22) Filed: Feb. 8, 2019

Related U.S. Application Data

(60) Provisional application No. 62/628,008, filed on Feb. 8, 2018.

(51) Int. Cl.
*E02D 17/08* (2006.01)
*E21D 5/00* (2006.01)

(52) U.S. Cl.
CPC ..... *E02D 17/08* (2013.01); *E02D 2200/12* (2013.01); *E02D 2200/1685* (2013.01); *E02D 2220/00* (2013.01); *E02D 2300/001* (2013.01); *E02D 2600/00* (2013.01)

(58) Field of Classification Search
CPC ..... E02D 17/08; E02D 2200/12; E02D 2200/1685; E02D 2200/00; E02D 2300/001; E02D 2600/00
See application file for complete search history.

(56) References Cited

U.S. PATENT DOCUMENTS 1,935,704 A * 11/1933 Fields ..... E02D 17/08 333/28 R
4,685,837 A * 8/1987 Cicanese ..... E02D 17/08 405/272
5,401,122 A * 3/1995 Pate, Jr. ..... E02D 17/08 405/133
6,161,359 A * 12/2000 Ono ..... E04G 1/14 14/75
2010/0104378 A1 4/2010 Moore et al.
2010/0209199 A1 8/2010 Pogue
2011/0318116 A1 12/2011 Cosentino
2015/0043977 A1 2/2015 Pogue
2016/0340853 A1 11/2016 Pogue

* cited by examiner

*Primary Examiner* — Tara Mayo-Pinnock
(74) *Attorney, Agent, or Firm* — Hall Estill Attorneys at Law

(57) ABSTRACT

Apparatus and associated methodology contemplating an excavation shoring apparatus, having a pipe sized to circumferentially enclose at least one human user working in a subterranean excavation. A plurality of channel brackets is attached to the pipe, each channel bracket forming an elongated cross-sectional profile defining a channel having a longitudinal axis extending along the channel bracket. The excavation shoring apparatus also has a plurality of selectively removable legs, each leg forming an elongated cross-sectional profile defining a beam. Each channel is configured to receivingly engage the beam in a closely-mating slidable relationship. The excavation shoring apparatus also has a plurality of removable fasteners, each connecting one of the legs to the respective channel bracket by simultaneously passing through an opening in the channel bracket and a selected opening of a plurality of openings in the leg. The selected opening in the leg corresponds to a desired position of the leg along the longitudinal axis.

17 Claims, 9 Drawing Sheets

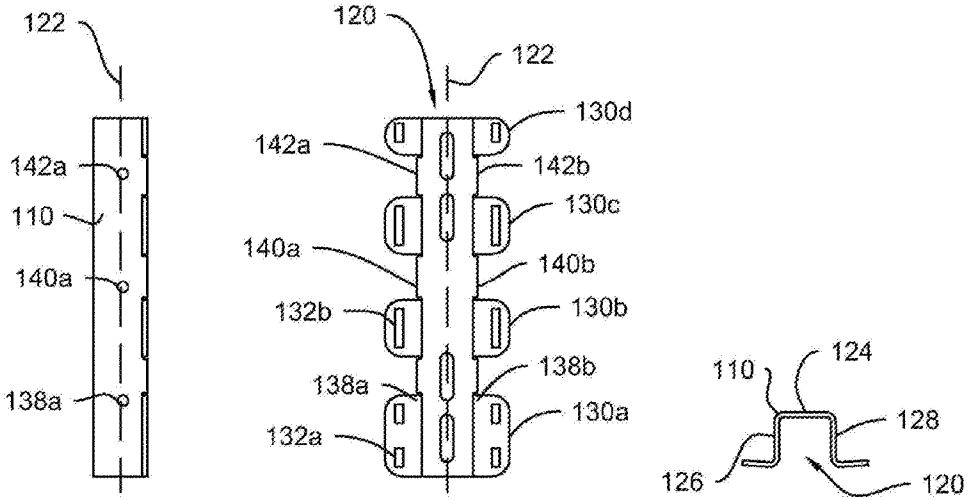
FIG. 5
FIG. 6
FIG. 7
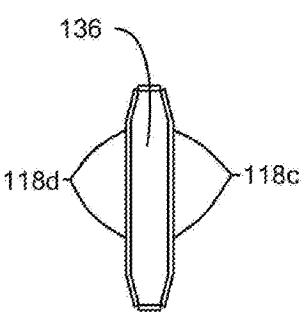
FIG. 10
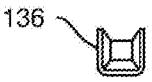
FIG. 9
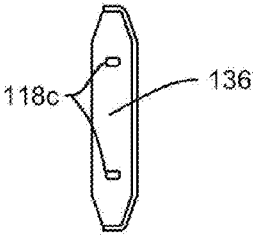
FIG. 8
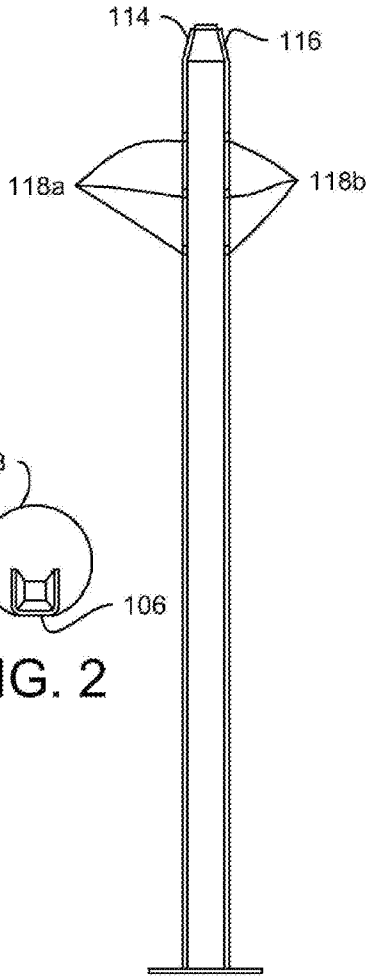
FIG. 4
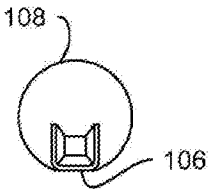
FIG. 2
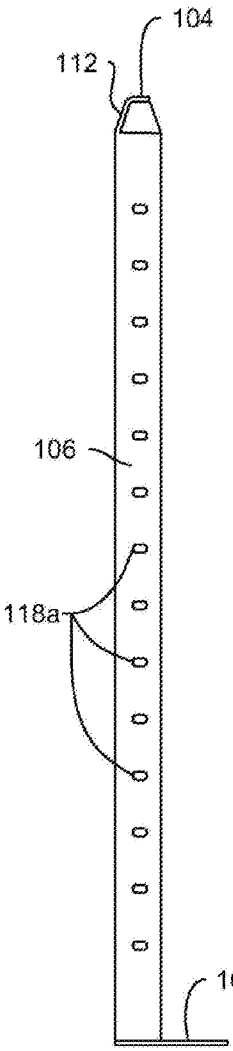
FIG. 3

EXCAVATION SHORING

RELATED APPLICATION

This application claims priority to the prior filing date of provisional application No. 62/628,008 entitled TRENCH SHORING, filed on Feb. 8, 2018.

SUMMARY

Embodiments of this technology contemplate an excavation shoring apparatus, having a pipe sized to circumferentially enclose at least one human user working in a subterranean excavation. A plurality of channel brackets is attached to the pipe, each channel bracket forming an elongated cross-sectional profile defining a channel having a longitudinal axis extending along the channel bracket. The excavation shoring apparatus also has a plurality of selectively removable legs, each leg forming an elongated cross-sectional profile defining a beam. Each channel is configured to receivingly engage the beam in a closely-mating slidable relationship. The excavation shoring apparatus also has a plurality of removable fasteners, each connecting one of the legs to the respective channel bracket by simultaneously passing through an opening in the channel bracket and a selected opening of a plurality of openings in the leg. The selected opening in the leg corresponds to a desired position of the leg along the longitudinal axis.

BRIEF DESCRIPTION OF THE DRAWINGS

FIG. 2 depicts a side view of each leg in the illustrative embodiments of FIGS. 1A-1C.

FIG. 3 depicts a top view of each leg in the illustrative embodiments of FIGS. 1A-1C.

FIG. 4 depicts a front view of each leg in the illustrative embodiments of FIGS. 1A-1C.

FIG. 5 depicts a side view of each channel bracket in the illustrative embodiments of FIGS. 1A-1C.

FIG. 6 depicts a bottom view of each channel bracket in the illustrative embodiments of FIGS. 1A-1C.

FIG. 7 depicts an elongated cross-sectional profile of each channel bracket in the illustrative embodiments of FIGS. 1A-1C.

FIG. 8 depicts a side view of each connecting pin in the illustrative 10 embodiments of FIGS. 1A-1C.

FIG. 9 depicts an end view of each connecting pin in the illustrative embodiments of FIGS. 1A-1C.

FIG. 10 depicts a rear view of each connecting pin in the illustrative embodiments of FIGS. 1A-1C.

DETAILED DESCRIPTION

Initially, this disclosure is by way of example only, not by limitation. The illustrative constructions and associated methods disclosed herein are not limited to use or application for any specific system or in any specific environment. That is, the disclosed technology is not limited to usage for shoring up a subterranean excavation as is disclosed in the illustrative embodiments. Thus, although the instrumentalities described herein are for the convenience of explanation, shown and described with respect to exemplary embodiments, the skilled artisan understands that the modular construction principles herein may be applied equally in other types of systems and environments involving protective shielding for a human user.

Figure 1A:
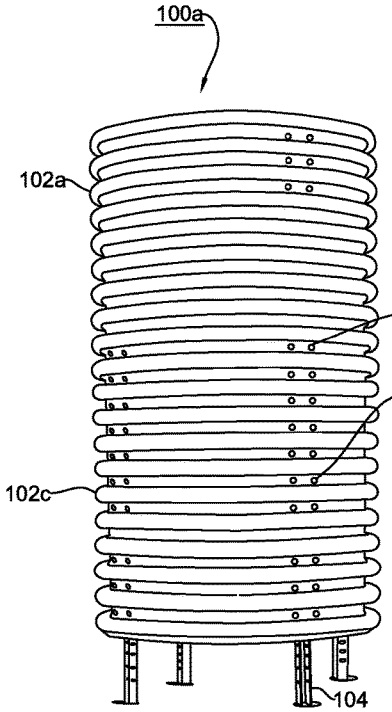
FIGS. 1A-1C depict depicts three differently-configured excavation shoring apparatuses configured within the modular construction embodiments of this technology.
Figure 1B:
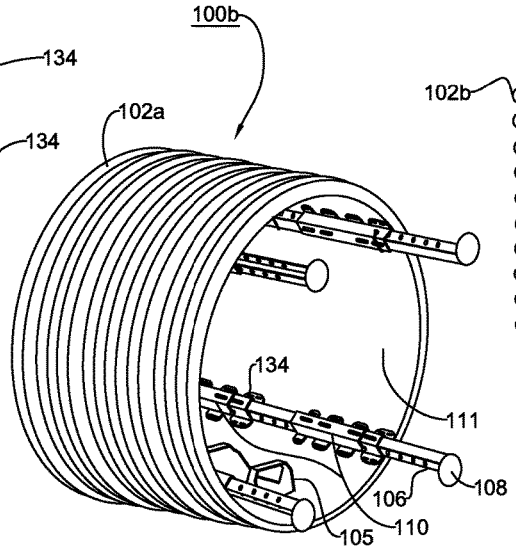
Figure 1C:
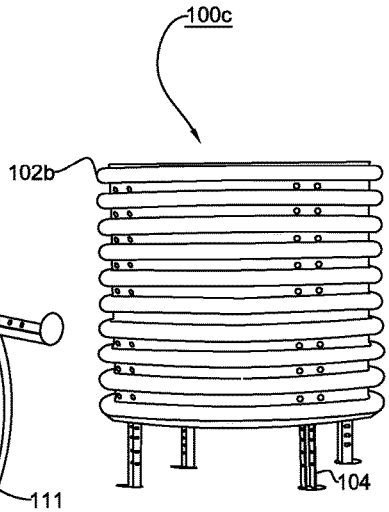

FIGS. 1A-1C depict three differently-configured and differently-employed excavation shoring apparatuses 100*a*, 100*b*, 100*c* according to the modular construction embodiments of this technology. The technology is marketed by the assignee of this application as a PolyShore® excavation shoring apparatus. Each apparatus 100 has one or more pipes 102*a*, 102*b*, 102*c*, which in these illustrative embodiments have the same diameter but different longitudinal lengths. For instance, in these illustrative embodiments, each pipe 102 can be a sixty-inch diameter dual wall polypropylene corrugated pipe constructed in accordance with ASTM F2881, such as that marketed by Prinsco, Inc. of Willmar, Minn. as Goldpro Storm™ pipe. The sixty-inch diameter of these illustrative embodiments is in no way limiting, alternatively the pipes 102 can be smaller or larger than sixty-inches in diameter.

For further instance, in these illustrative embodiments, the pipes 102*a*, 102*b*, 102*c* can have lengths of four feet, five feet, and six feet, respectively. These lengths are entirely illustrative for purposes of this disclosure, not limiting of the contemplated embodiments which encompass lengths shorter than four feet and longer than six feet.

Generally, various-length configurations provide for a modular construction permitting rapid and easy adjustments by stacking the individual pipes, such as illustratively depicted by excavation shoring apparatus 100*a* that is formed by stacking a four-foot pipe 102*a* on top of a six-foot pipe 102*c* to accommodate deeper excavations.

The excavation shoring apparatus 100*b* is depicted laying horizontally on its side. The lightweight, predominantly polymeric, construction and round shape makes it quite possible for one person to position the excavation shoring apparatus 102 during transit or site installation by rolling it around. In use, the excavation shoring apparatus 100 is typically placed vertically into a subterranean excavation, or other excavation, to shore up the excavation and thus provide a man-hole shield for one or more human workers inside the pipe 102. An advantage of these illustrative embodiments is that the lightweight construction enables the pipe 102 to be unloaded and transported to the worksite with relative ease in comparison to the previously attempted solutions that are typically constructed of steel and/or concrete, and the like.

Each of the excavation shoring apparatuses 100 has a plurality of vertically-adjustable legs 104 for varying the position of the pipe 102 above the bottom of the excavation. Each leg 104 has a beam 106 terminating at a lower end with a pad 108 that distributes the weight to prevent the leg 104 from sinking into the subterranean excavation floor. In these illustrative embodiments there are four legs 104, but less or more than four are contemplated within alternative embodiments of this technology.

Each leg 104 is supported to slide vertically within a respective channel bracket 110 that is attached to the inner surface 111 of the pipe 102. Thus, the excavation shoring apparatus 100 of this technology contemplates a first set of channel brackets 110 having a like-number as there are legs 104; one channel bracket 110 for each leg 104. In these illustrative embodiments that first set is depicted being attached around the bottom-end of the pipe 102. Another set of channel brackets 110 can also be employed for purposes discussed below, in these depicted illustrative embodiments they are attached around the top-end of the pipe 102. Although in these illustrative embodiments the two sets contain the same channel bracket 110, in alternative embodiments the different sets can be differently configured to address the different purposes they serve. Furthermore, in these depicted illustrative embodiments respective pairs of the first and second sets are longitudinally-aligned with each other. This arrangement is only illustrative, not limiting of the contemplated embodiments, because alternatively the channel brackets 110, such as at opposing ends of the pipe 102, could be longitudinally offset from each other and still perform their different purposes as described herein.

Besides the legs 104 and channel brackets 110, FIGS. 1A-1C also depict the excavation shoring apparatuses 100 of this technology can include a built-in ladder 105 making it easier for a user to climb into or climb out of the protective pipe 102 in the subterranean excavation.

FIGS. 2-4 depict top, side, and front views, respectively, of the leg 104 constructed in accordance with illustrative embodiments of this technology. Generally, the beam 106 forms an elongated cross-sectional profile that in these illustrative embodiments is uniformly rectangular, as best depicted in the top view of FIG. 2. The leading end of the beam 106, opposite the pad 108, is formed to define tapered rear and side portions 112, 114, 116, respectively, collectively forming a tapered end for facilitating entry of the beam 106 into the respective channel member 110. The opposing sides of the beam 106 define respective arrays of aligned openings 118*a*, 118*b* for connecting the beam 106 to the respective channel bracket 110, as discussed below.

FIGS. 5-7 depict side, bottom, and end views, respectively, of the channel bracket 110 constructed in accordance with illustrative embodiments of this technology. Generally, the channel bracket 110 forms an elongated cross-sectional profile defining a channel 120 having a longitudinal axis 122 extending along the channel bracket 110. The channel 120 is configured to receivingly engage the beam 106 in a close-mating slidable relationship. That is, the beam 106 is configured to slide within the channel 120 in a closely mating relationship, permitting the beam 106 to be selectively positioned along the longitudinal axis 122.

In these illustrative embodiments, the channel bracket 110 has a top member 124 with opposing side members 126, 128 extending therefrom to define an open rectangular cavity 120 that is configured to matingly engage the rectangular cross-sectional profile of the beam 106. In alternative equivalent embodiments not depicted, the channel and beam can be shaped differently than rectangular so long as they cooperatively provide for a close-mating sliding relationship.

The channel bracket 110 in these illustrative embodiments has a number of laterally-directed flanges 130 defining respective openings 132. Although some of the depicted flanges 130 and openings 132 are differently configured, the depicted configurations are merely illustrative and not limiting of the contemplated embodiments of this technology. In alternative embodiments the flanges and openings can all be different or can all be the same without departing from the embodiments of this technology.

The channel bracket 110 is positioned so that the open end of its channel 120 abuttingly engages against the inner surface 111 (see FIGS. 1A-1C) of the pipe 102. FIG. 7 best depicts how the flanges 130 can be slightly underbent to better conform to the arcuate inner surface 111 of the pipe 102. Fasteners 134 (see FIGS. 1A-1C) are then passed through the openings 132 and through aligned openings in the pipe 102 to attach the channel bracket 110 to the inner surface 111 of the pipe 102. Although in these depicted embodiments the channel brackets 110 are attached in this manner to the inside surface 111 of the pipe 102, this is illustrative and not limiting of the contemplated embodiments. In alternative embodiments, the legs and/or their supporting mechanisms can be partly or entirely attached to the outer surface or to the ends of the pipe 102.

Thus, in these illustrative embodiments attaching the channel bracket 110 to the inner surface 111 of the pipe 102 closes the channel 120 to operably retain the beam 106 portion of the leg 104 within the longitudinal channel 120, while providing adequate clearance to preserve the selectively slidable relationship of the leg 104 relative to the channel bracket 110.

FIGS. 8-10 depict side, end, and front views, respectively, of a connecting pin 136 that is employed in the second set of channel brackets 110 depicted at the top of the pipe 102 in FIGS. 1A-1C to connect two stacked pipes 102. In these illustrative embodiments, the connecting pins 136 form substantially the same elongated cross-sectional profile and tapered ends as the beam 106 portion of the leg 104. The elongated rectangular portion of the connecting pin 136 likewise forms opposing arrays of openings 118*c*, 118*d* serving a similar purpose as the arrays of openings 118*a*, 118*b* in the beam 106 portion of the leg 104.

In this manner, any particularly channel bracket 110 can be used to receivingly engage either a leg 104 or a connecting pin 136. That advantageously provides a modular construction that makes any particular excavation shoring apparatus 100 suitable for a number of different applications. Namely, for instance, the channel brackets 110 can be used to support legs 104 in one application where the excavation shoring apparatus 100 is situated at the bottom of the subterranean excavation. Then, the legs 104 can be removed and the same channel brackets 110 can be used to alternatively support connecting pins 136 in another application where the excavation shoring apparatus 100 is situated on top of another excavation shoring apparatus in the bottom of the subterranean excavation.

So preferably, the channel brackets 110 at opposing ends of the pipe 102 are the same cross-sectional size, and the legs 104 and connecting pins are the same cross-sectional size, so that the user can selectively insert either a leg 104 or a connecting pin 136 into any particular channel bracket 110. This modular construction permits making either end of the pipe 102 the bottom end and the other end the top end, depending on where the user attaches the legs 104.

Figure 11:
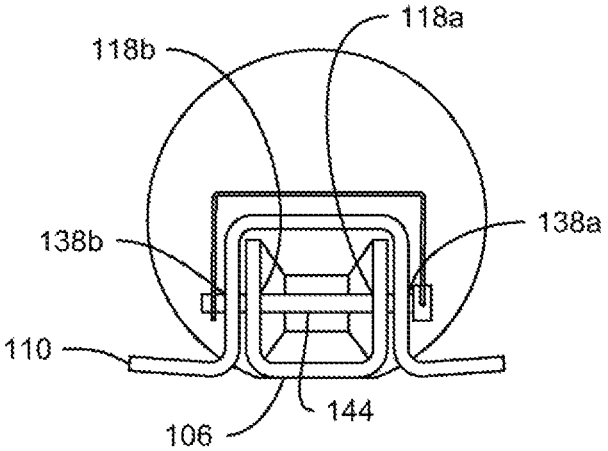
FIG. 11 depicts a top view of a removable connector connecting the leg to the channel bracket.
Figure 12:
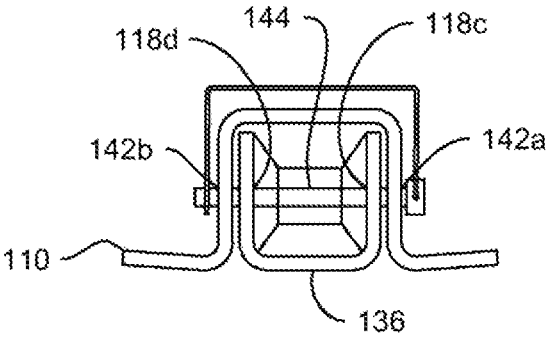
FIG. 12 depicts a top view of a removable connector connecting the connecting pin to the channel bracket.

FIGS. 5 and 6 best depict how the channel bracket 110 defines aligned opposing arrays of openings 138*a*, 140*a*, 142*a* on one side and 138*b*, 140*b*, and 142*b* on the other side. As best shown in FIG. 11, the beam 106 portion of the leg 104 can be connected to the channel bracket 110 by passing a removable fastener 144, such as the depicted safety snap pin, through the holes 138*a*, 138*b* in the channel bracket 110 when they are aligned with the holes 118*a*, 118*b* in the beam 106. Similarly, as best shown in FIG. 12, the connecting pin 136 can be connected to the channel bracket 110 by passing the removable fastener 144 through the holes 142*a*, 142*b* in the channel bracket 110 when they are aligned with the holes 118*c*, 118*d* in the connecting pin 136.

Figure 15:
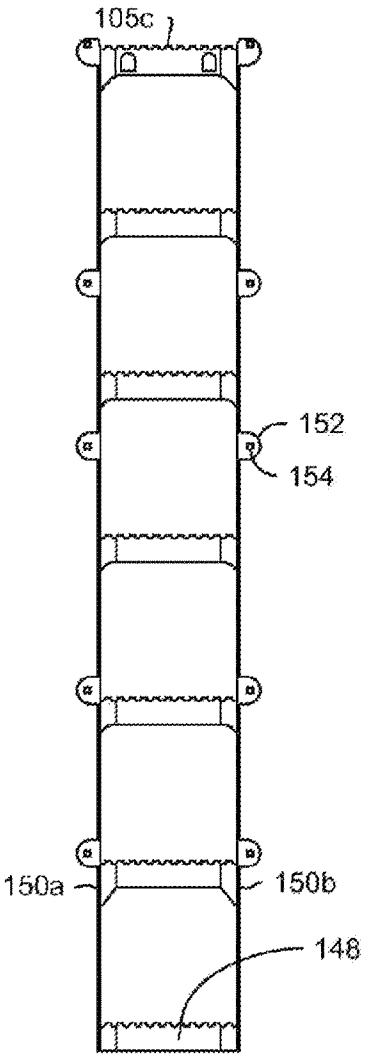
FIG. 15 depicts yet another alternative step ladder in the illustrative embodiments of FIGS. 1A-1C.
Figure 14:
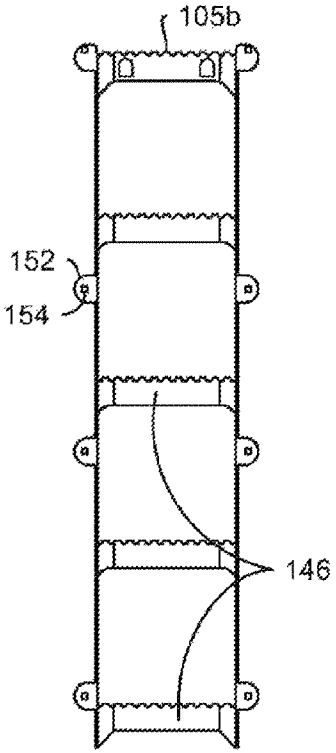
FIG. 14 depicts an alternative step ladder in the illustrative embodiments of FIGS. 1A-1C.
Figure 13:
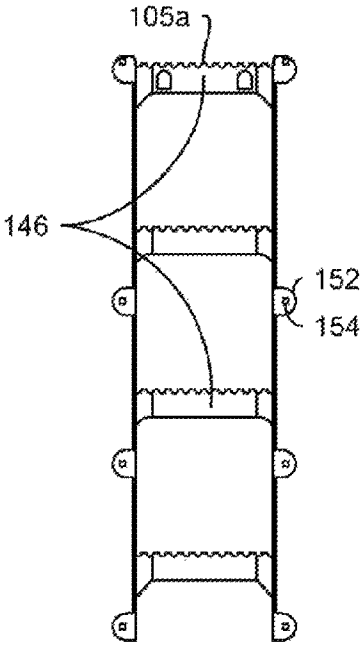
FIG. 13 depicts an illustrative step ladder in the illustrative embodiments of FIGS. 1A-1C.
Figure 19:
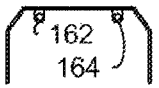
FIG. 19 depicts an end view of the top movable portion of the folding ladder of FIG. 16.
Figure 20:
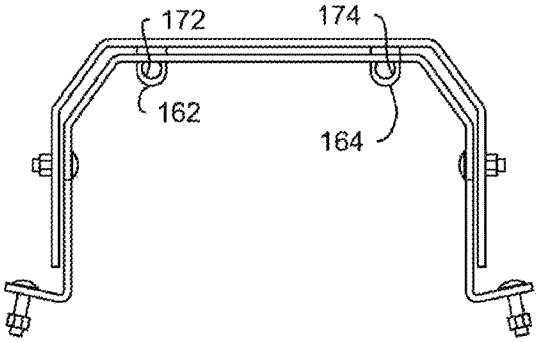
FIG. 20 depicts an end view of the folding ladder of FIG. 16 in the folded-down arrangement of the top and bottom portions.
Figure 18:
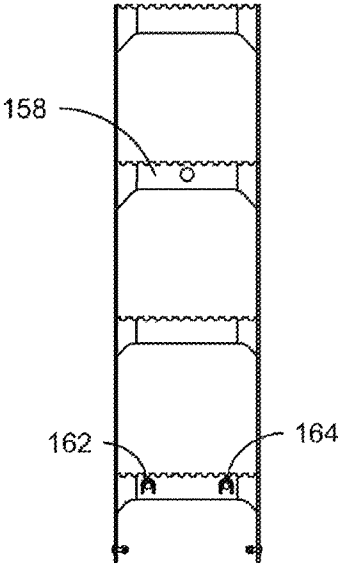
FIG. 18 depicts the top movable portion of the folding ladder of FIG. 16.
Figure 17:
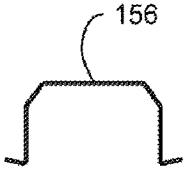
FIG. 17 depicts an elongated cross-sectional profile of the bottom stationary portion of the folding ladder of FIG. 16.

FIGS. 13-15 depict step ladders 105*a*, 105*b*, 105*c* configured to fit within the confines of the pipes 102*a*, 102*b*, 102*c* (see FIGS. 1A-1C), respectively, in accordance with illustrative embodiments of this technology. The ladders 105 generally have a plurality of protuberant steps 146 that are ergonomically spaced apart for climbing, such as about twelve inches apart. Upper surfaces of the steps 146 can be formed with corrugations or some other type of slip-resistant surface feature or material. The step ladder 105*c* in FIG. 15 depicts a pivotable bottom step 148, it is selectively positionable between the lowered position depicted and a raised position by pivoting it upward around opposing pin connections 150*a*, 150*b* between it and the framework forming the other six steps. Similar to the channel bracket 110 construction, the step ladders 105*a*, 105*b*, 105*c* have laterally-extending flanges 152 defining respective openings 154 for passing fasteners 134 (see FIGS. 1A-1C) therethrough and through aligned openings in the pipe 102 to attach the ladder 105 to the pipe 102.

Figure 16:
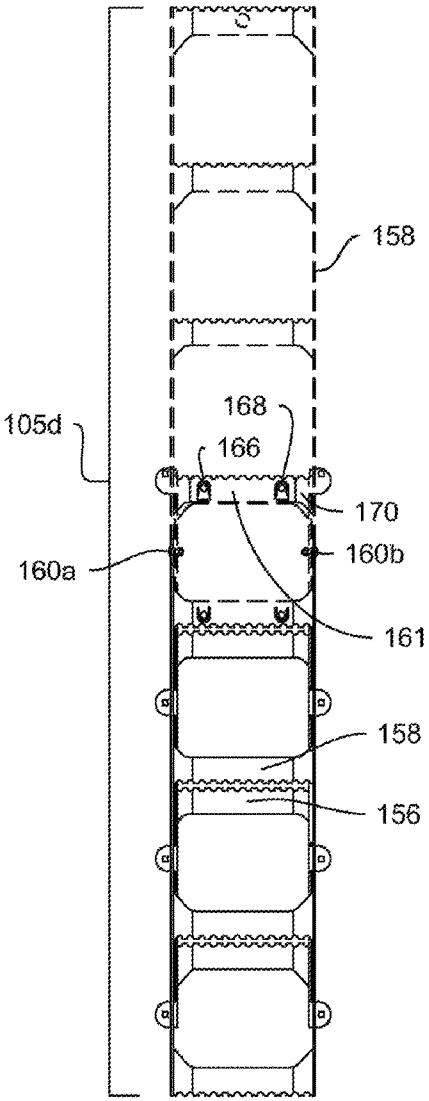
FIG. 16 depicts a folding ladder in the illustrative embodiments of FIGS. 1A-1C.

FIGS. 16-20 depict a folding ladder 105*d* that is constructed in accordance with alternative embodiments of this technology. The folding ladder 105*d* has a stationary bottom portion 156 and a pivotable top portion 158, joined together by pinned connections 160*a*, 160*b*. FIG. 16 depicts the folding ladder 105 arranged in a folded-down mode in solid lines, and also depicts the top portion 158 repositioned to the folded-up mode in broken lines. The bottom portion 156 has an elongated cross-sectional profile depicted in FIG. 17, which is similar to the step ladders 105*a*, 105*b*, 105*c* depicted in FIGS. 13-15. The top portion 158 has an elongated cross-sectional profile depicted in FIG. 19, configured to wrap around the bottom portion's profile in the folded-down mode. In these illustrative embodiments, the lowermost step 161 of the top portion 158 forms a pair of protuberant tabs 162, 164 that mate into respective openings 166, 168 formed in the uppermost step 170 of the bottom portion 156. As best depicted in the end view of the folded-up mode in FIG. 20, the tabs 162, 164 can form respective openings 172, 174 through which a locking device can be inserted to lock the folding ladder 105*d* in the folded-up mode, such as inserting the shackle portion of a padlock or the shaft of a screwdriver, and the like.

Figure 22:
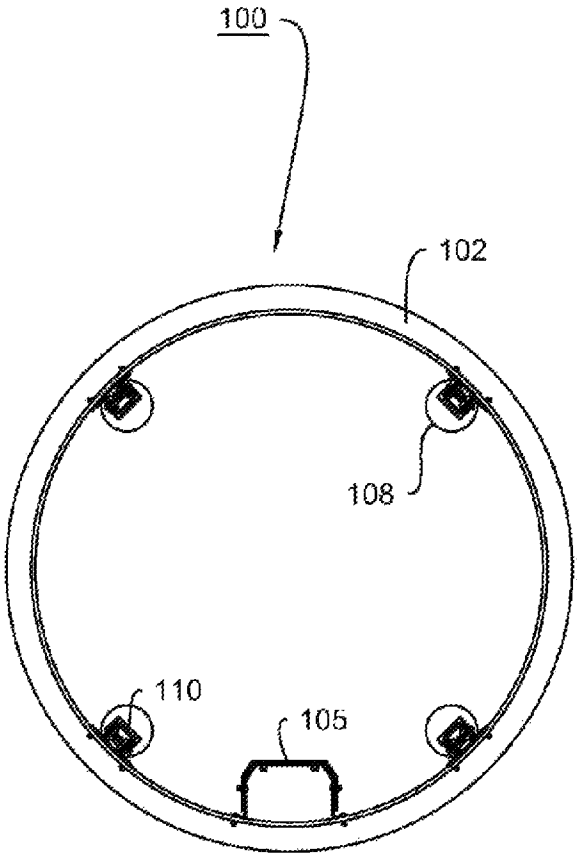
FIG. 22 depicts a top view of the excavation shoring apparatus in FIG. 21.
Figure 21:
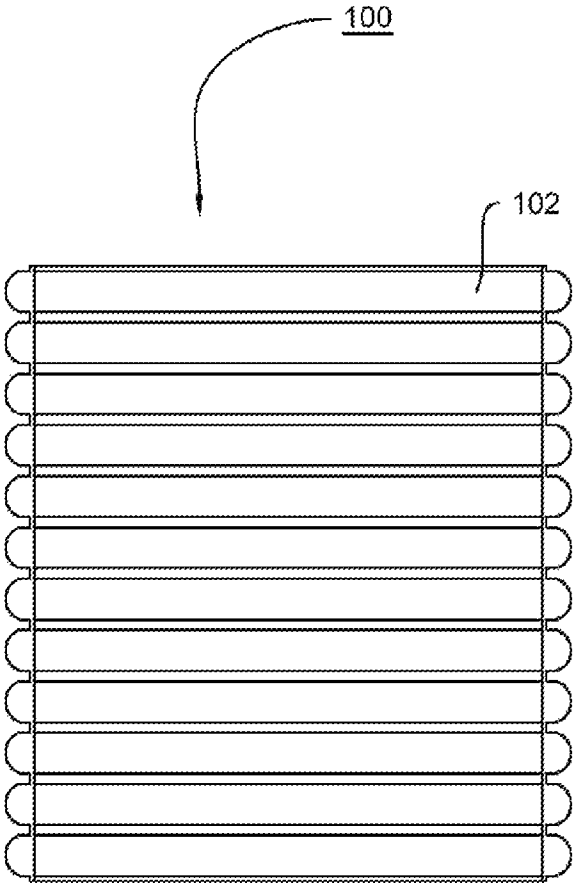
FIG. 21 depicts an elevational view of an illustrative excavation shoring apparatus constructed generally in accordance with the embodiments of this technology.

Summarizing all that's gone before, FIGS. 21 and 22 depict a modular building block of this technology, an excavation shoring apparatus comprising a pipe 102, a plurality of channel support members 110 and a ladder 105 attached to the pipe 102.

The channel support members 110 can be employed to attach either a leg 104 or a connecting pin 136 to the pipe 102 as well. The following description now shifts to illustrative arrangements made possible by the modular construction of this technology.

Figure 25:
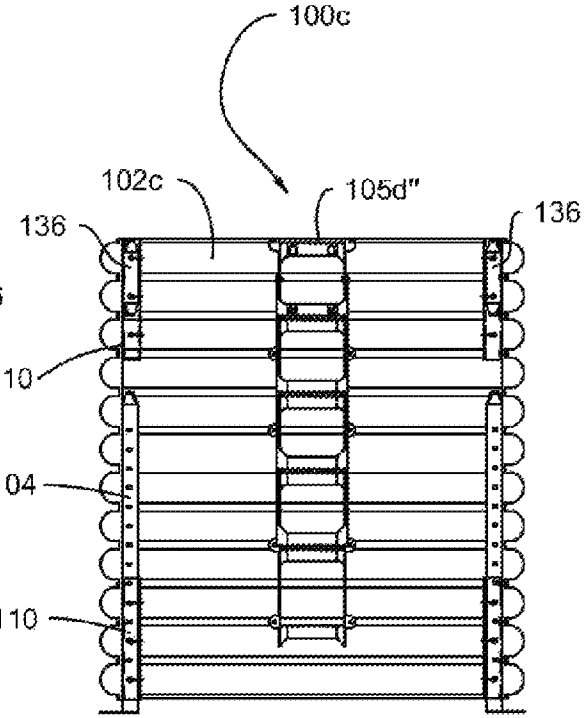
FIGS. 23-25 depict various structural configurations of the excavation shoring apparatus in FIGS. 21 and 22.
Figure 24:
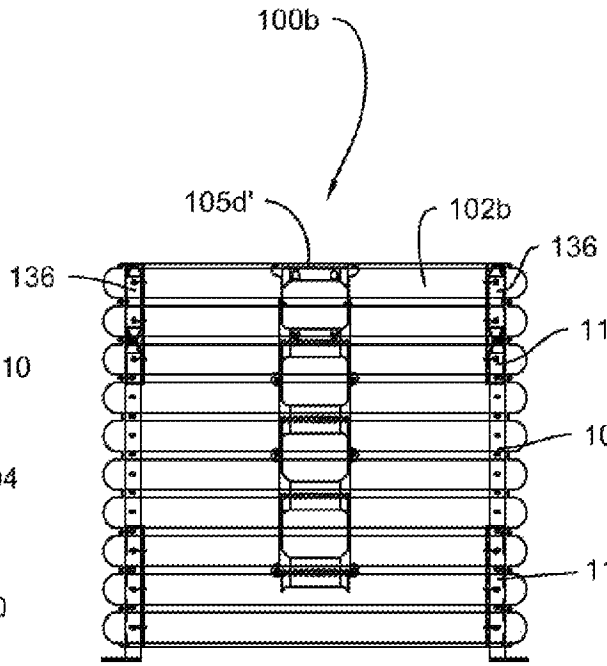
Figure 23:
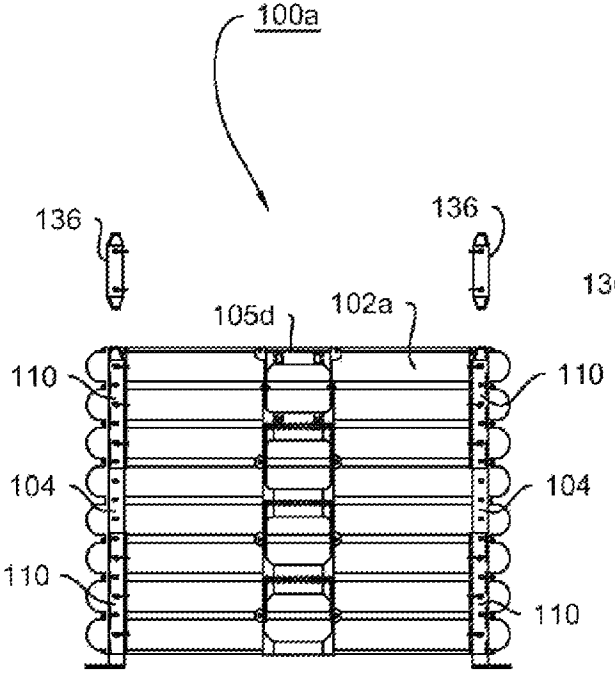

FIGS. 23-25 diagrammatically depict the excavation shoring apparatuses 100*a*, 100*b*, 100*c*, each outfitted with a first set of channel brackets 110 at the lower end of the respective pipes 102*a*, 102*b*, 102*c* and a second set of channel brackets 110 at the upper end of the respective pipes 102*a*, 102*b*, 102*c*. Fully retracted legs 104 are pinned to the lower set of channel brackets 110, a position conducive to transporting the excavation shoring apparatus 100 to the subterranean excavation where it'll be utilized. Note that in the excavation shoring apparatus 100*a* in FIG. 23, the beam 106 portion of the legs completely fills the upper set of channel brackets 110 as well since the lower and upper sets of channel brackets 110 are aligned in respective pairs. In this case, the connecting pins 136 have to be transported separately, whereas the longer lengths of excavation shoring apparatuses 100*b*, 100*c* provides room in the upper set of channel brackets 110 for connecting the connecting pins 136 in a fully retracted position. The excavation shoring apparatus 100*a* is also equipped with the folding ladder 105*d* discussed above, in these illustrative embodiments. The longer excavation shoring apparatuses 100*b*, 100*c* are equipped with modified folding ladders 105*d*', 105*d*" that add one and two additional stationary steps to safely provide the lowermost step within about two feet of the bottom of the pipe 102*b*, 102*c*. Again, the ladders 105 are all depicted in the retracted position, most suitable for transporting the excavation shoring apparatus 100 to the job site and for storage between usages.

Figure 28:
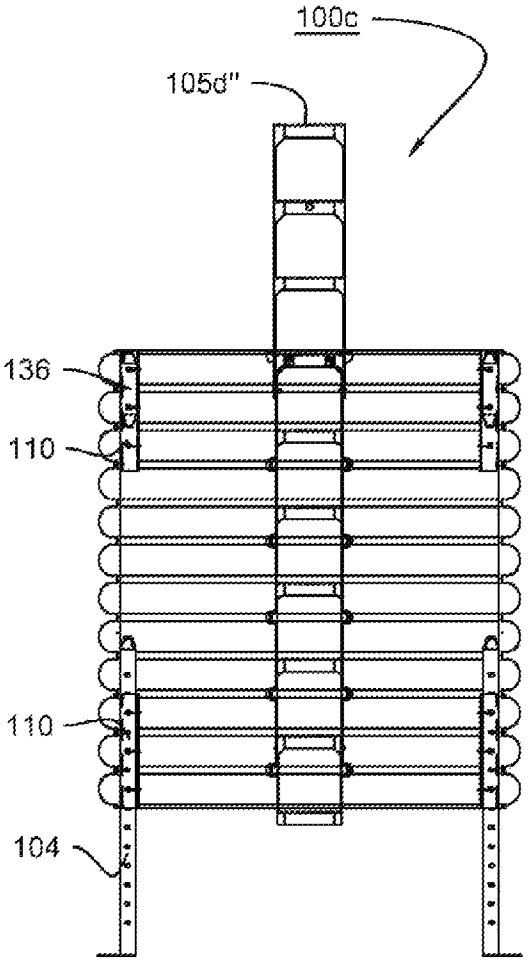
FIGS. 26-28 depict the excavation shoring apparatuses in FIGS. 23-25 with their legs and ladders extended to provide the subterranean excavation shoring of this technology.
Figure 27:
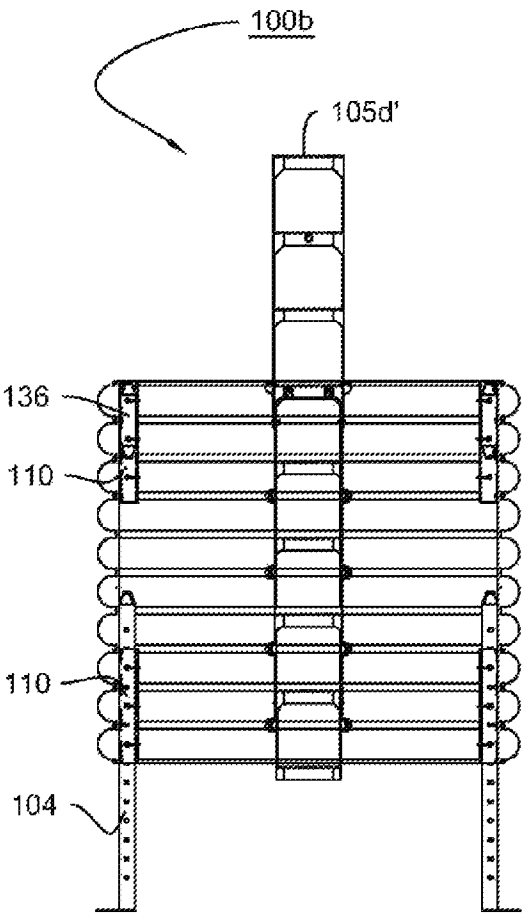
Figure 26:
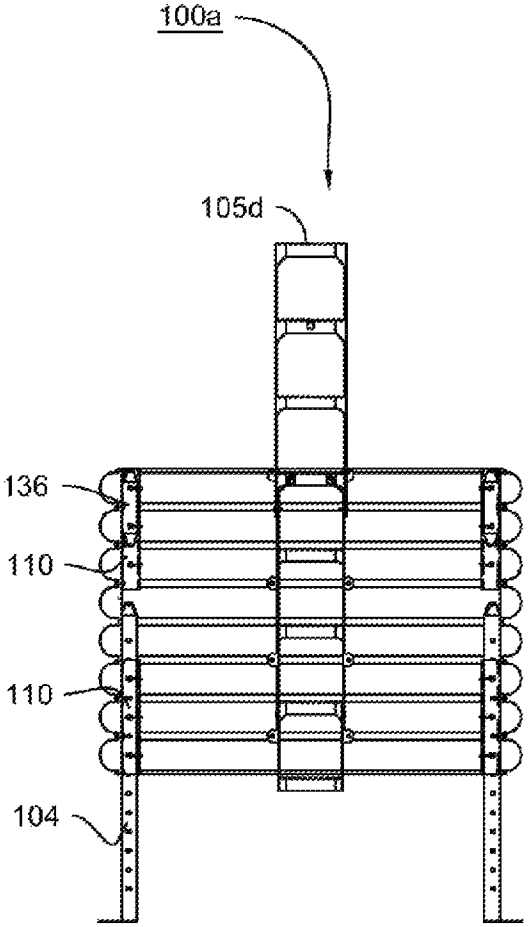
Figures 29, 30, 31:
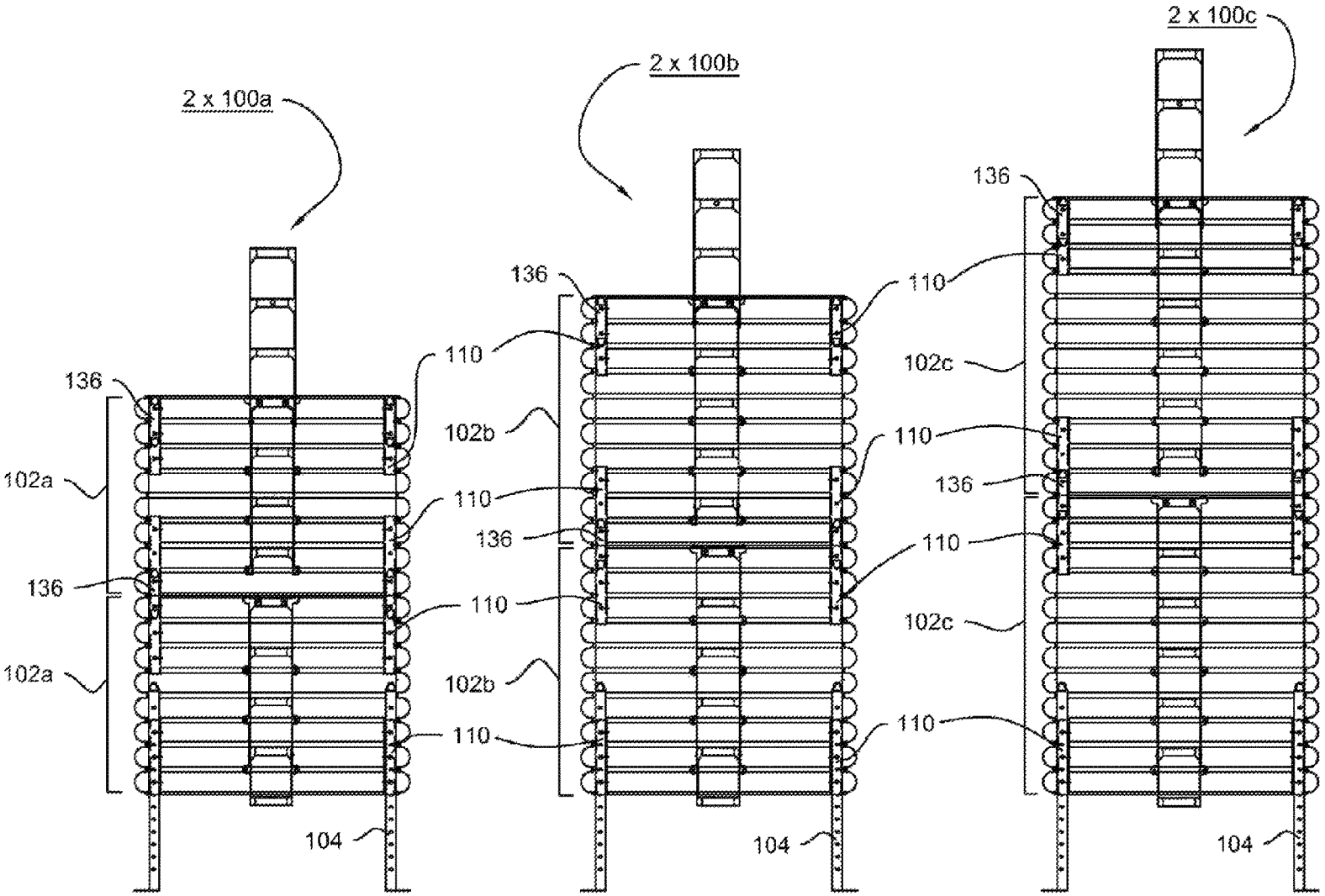
FIGS. 29-31 depict various illustrative embodiments of deeper subterranean excavation shoring that is modularly constructed by stacking two of the excavation shoring apparatuses in FIGS. 23-25.

FIGS. 26-28 depict the excavation shoring apparatuses 100*a*, 100*b*, 100*c* of FIGS. 23-25, respectively, but after the legs 104 and ladders 105 are extended as they are employed in the subterranean excavation as individual units. Finally, FIGS. 29-31 depict yet other alternative embodiments involving stacking two of the excavation shoring apparatuses together to reach the bottom of deeper subterranean excavations. In these illustrative embodiments, FIG. 29 depicts stacking two of the shortest excavation shoring apparatuses 100*a*, FIG. 29 depicts stacking two of the middle-length excavation shoring apparatuses 100*b*, and FIG. 31 depicts stacking two of the longest-length excavation shoring apparatuses 100*c*. In each arrangement, half of each connecting link 136 is attached to the channel bracket 110 at the top of the lower excavation shoring apparatus 102, and the other half of each connecting link 136 is attached to the channel bracket 110 at the bottom of the upper excavation shoring apparatus 102.

In these illustrative embodiments of FIGS. 29-31 only the top unit of the stacked excavation shoring apparatuses 100 has a folding ladder 105*d*. Although the bottom stationary ladder 105*a*, 105*b*, 105*c* in each arrangement does not need to be folded-up to reach the top folding ladder 105*d* in these illustrative embodiments, equipping all of the excavation shoring apparatuses 100 with the folding ladder 105*d* can further the modularity of this technology in that, being equipped with the folding ladder 105*d*, any particular excavation apparatus 100 can effectively be employed as either the top or bottom unit in a stacked pair of units. So in alternative equivalent embodiments not depicted, both of the stacked units can be equipped with a stationary ladder 105*a*, 105*b*, 105*c* or both of the stacked units can be equipped with a folding ladder 105*d*.

The various features and alternative details of construction of the apparatuses described herein for the practice of the present technology will readily occur to the skilled artisan in view of the foregoing discussion, and it is to be understood that even though numerous characteristics and advantages of various embodiments of the present technology have been set forth in the foregoing description, together with details of the structure and function of various embodiments of the technology, this detailed description is illustrative only, and changes may be made in detail, especially in matters of structure and arrangements of parts within the principles of the present technology to the full extent indicated by the broad general meaning of the terms in which the appended claims are expressed.

What is claimed is:

1. An excavation shoring apparatus, comprising:

a pipe sized to circumferentially enclose at least one human user working in a subterranean excavation;

a plurality of channel brackets attached to the pipe, each channel bracket forming an elongated cross-sectional profile defining a channel having a longitudinal axis extending along the channel bracket;

a plurality of legs, each leg forming an elongated cross-sectional profile defining a beam, each channel configured to receivingly engage the beam in a closely-mating slidable relationship, and each leg terminating at a laterally-extending pad configured to contact a floor of the excavation and distributing the pipe's weight to the floor laterally beyond the beam; and a plurality of removable fasteners, each fixing one of the legs to the respective channel bracket by simultaneously passing through an opening in the channel bracket and through a selected an opening in the leg corresponding to a desired fixed position of the leg along the longitudinal axis.

2. The apparatus of claim 1 wherein the pipe comprises a polymeric material.

3. The apparatus of claim 2 wherein the pipe comprises polypropylene.

4. The apparatus of claim 2 wherein the plurality of channel brackets includes a first channel bracket attached nearer to a lower end of the pipe, and the apparatus further comprising a second channel bracket attached nearer to an upper end of the pipe.

5. The apparatus of claim 4 wherein the first and second channel brackets are longitudinally aligned.

6. The apparatus of claim 4 wherein the plurality of legs includes a first leg fixed in place in the first channel bracket and a connecting pin fixed in place in the second channel bracket.

7. The apparatus of claim 6 wherein the connecting pin has an elongated cross-sectional profile configured substantially the same as the leg's beam.

8. The apparatus of claim 6 wherein an upper end of the connecting pin extends above a top of the pipe.

9. The apparatus of claim 8 wherein the pipe is a first pipe and further comprising a second pipe on top of the first pipe, the second pipe having a channel bracket in which the upper end of the connecting pin is receivingly fixed.

10. The apparatus of claim 4 wherein the first and second channel brackets form an aligned pair of channel brackets, the apparatus comprising a plurality of aligned pairs of channel brackets.

11. The apparatus of claim 3 comprising four aligned pairs of channel brackets.

12. The apparatus of claim 2 further comprising a ladder attached to the pipe.

13. The apparatus of claim 12 wherein the ladder comprises a selectively foldable portion.

14. The apparatus of claim 1 wherein the pipe has a diameter that is greater than about 48 inches.

15. The apparatus of claim 14 wherein the pipe has a diameter of about 60 inches.

16. A method, comprising:

obtaining an excavation shoring apparatus having a polymeric pipe sized to circumferentially enclose at least one human user working in a subterranean excavation, a plurality of channel brackets attached to the pipe, each channel bracket forming an elongated cross-sectional profile defining a channel having a longitudinal axis extending along the channel bracket;

placing a leg in each of the channels, each leg forming an elongated cross-sectional profile defining a beam, each channel configured to receivingly engage the beam in a closely-mating slidable relationship, and each leg terminating at a laterally-extending pad configured to contact a floor of the excavation and distributing the pipe's weight to the floor laterally beyond the beam; and fixing each leg to the corresponding channel bracket by inserting a respective removable fastener simultaneously through an opening in the respective channel bracket and through a selected opening in the respective leg corresponding to a desired fixed position of the leg along the longitudinal axis.

17. The method of claim 16 wherein the plurality of channel brackets includes a first channel bracket attached nearer a lower end of the pipe supporting the leg, and the apparatus further having a second channel bracket nearer an upper end of the pipe, comprising:

placing a connecting pin in the second channel bracket; and fixing the connecting pin to the second channel bracket by inserting a removable fastener through an opening in the second channel bracket and through an opening in the connecting pin.

* * * * *